US005242071A

United States Patent [19]

Goebel

[11] Patent Number: 5,242,071

[45] Date of Patent: Sep. 7, 1993

[54] STACKABLE MULTI-COMPARTMENTAL CONTAINER

[76] Inventor: Scott A. Goebel, 5607 Nall, Mission, Kans. 66202

[21] Appl. No.: 941,565

[22] Filed: Sep. 8, 1992

[51] Int. Cl.[5] ..... B65D 6/00

[52] U.S. Cl. ..... 220/4.23; 220/4.26; 220/23.8; 220/520; 206/515; 206/518

[58] Field of Search ..... 206/518, 519, 515; 220/23.4, 4.23, 23.2, 535, 4.26, 23.8, 520

[56] References Cited

U.S. PATENT DOCUMENTS

| | | | |
|---|---|---|---|
| 863,536 | 8/1907 | Hudson | 220/23.4 |
| 1,855,075 | 4/1932 | Virneburg | 220/23.2 |
| 2,640,623 | 6/1953 | Ryder | 220/23.4 |
| 2,738,893 | 3/1956 | Quinones, Jr. | 220/23.4 |
| 3,409,193 | 11/1968 | Metcalf | 220/23.4 |
| 3,757,388 | 9/1973 | Wolny | 220/4.23 |
| 4,133,445 | 1/1979 | Mandelbaum | 220/23.4 |
| 4,298,156 | 11/1981 | Reifers et al. | 206/518 |
| 4,618,090 | 10/1986 | Cortellucci | 220/4.23 |
| 4,989,746 | 2/1991 | Pierce | 220/335 |

*Primary Examiner*—Joseph Man-Fu Moy

*Attorney, Agent, or Firm*—D. A. N. Chase; Michael Yakimo, Jr.; Richard P. Stitt

[57] ABSTRACT

A container having fixed sectional dividers is provided, the sections being hingedly connected to permit stacking of one container within another and equipped with a container section latch to connect the container sections while in use.

8 Claims, 1 Drawing Sheet

STACKABLE MULTI-COMPARTMENTAL CONTAINER

BACKGROUND OF THE INVENTION

This invention relates to containers for food and refreshments. In particular, the present invention provides a divided container designed to fit one within another, thereby providing stackable containers which can fit closely one within another for ease of storage and shipment.

Sales of food and drink in paper and plastic containers has achieved wide acceptance among consumers. Such devices are particularly utilized in convenience stores and entertainment concession areas where they are used for sales of drinks and food such as popcorn, peanuts, etc. With respect to soft drinks, and beverages generally, a wide selection of flavors is available and it is often the case that consumer may desire more than one flavor of beverage at a time. Currently, the only option for enjoyment of multiple selections of beverage flavors is to utilize separate containers for each separate beverage. This situation can present inconvenience and difficulties if the individual is driving an automobile or carrying other objects or otherwise engaged.

Multiple containers may be especially inconvenient in the situation of an adult caring for a small child. Often the adult desires one flavor of drink and the child desires an alternate flavor. If the infant is too small to manipulate the container themselves, the parent must hold both containers and offer the child its beverage upon request. This requires the adult to manipulate two separate beverage containers, as well as the child, while conducting whatever other activity in which they are engaged.

Alternatively, at concession stands of theaters or parks or other entertainment situations, it is often the case that popcorn, peanuts, pretzels, ice cream or a shake or other types of food are concurrently offered to the public and the consumer wishes to enjoy two or more such foods. Also, it is often the case that while walking about the park or sitting in the theater two or more individuals wish to eat different foods but would prefer not to have large portions or manipulate a variety of containers—popcorn and buttered popcorn and beverages. Presently the consumer has no choice other than to purchase each different food item in a separate container.

A principal reason that concession stands avoid using subdivided containers is that if the dividers are fixed in place it is not possible for the containers to be stacked one within another. In this situation, the containers must either be stored in partially assembled fashion necessitating assembly by the concession personnel or the containers are stored assembled thus consuming large amounts of storage space in the concession area.

Therefore, it is an object of the present invention to provide a subdivided foodstuff container which may be stacked one within the other in a completely assembled and ready-to-use fashion thereby avoiding the foregoing debilities of previous containers while allowing the consumer to select and carry multiple and different foods within a single container.

In summary the invention contemplates multiple food or beverage container sections connected together at a portion of a first sidewall edge thereby permitting an opposite or second sidewall edges of the container sections to be spaced apart so to permit insertion of a first sectioned container within a similar container. Latch means in the nature of a frictionally fitting bead and detente arrangement is provided on said container sections to enable connection of the container sections in fixed adjacent array.

DESCRIPTION OF THE PREFERRED EMBODIMENT

Figure 1:
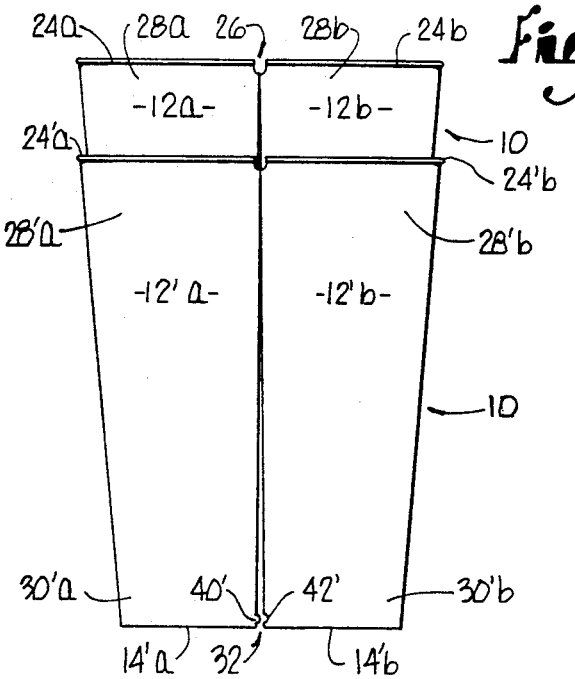
FIG. 1 is a side elevational view of two containers with one inserted within the other for storage purposes.

Referring now to FIG. 1 two containers embodying the invention are shown with a first container 10 introduced into the interior of a second container 10'. Each of containers 10 and 10' are divided into sections **12*a*, 12*b* and 12'*a*, 12'*b*. The sections may be aligned with one another to permit insertion of a first container within a second as exemplified by container 10 inserted within container 10'. The material of construction for container 10, 10'** may be any of the conventional materials utilized in such containers such as paper or plastic. It may be useful to coat paper materials to prevent leakage of fluids.

Figure 2:
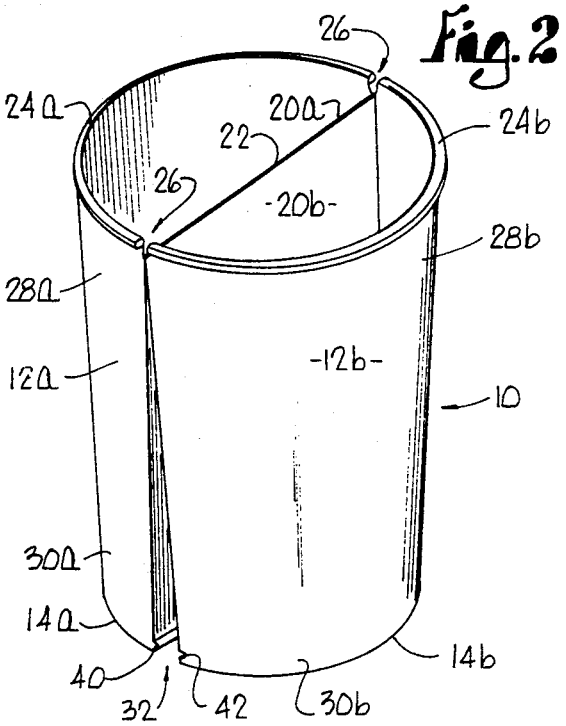
FIG. 2 is a perspective view of a container subdivided into two compartments and showing the lower sidewall edges of the subdivisions separated.

Referring now to FIG. 2, container 10 embodying the present invention, is shown in perspective view. Divider walls **20*a*, 20*b* are shown bisecting container 10 into sections 12*a*, 12*b*. Divider wall 20*a* and divider wall 20*b* are connected at upper sidewall edge 28*a*, 28*b* of container 10 by hinge 22. Hinge means 22 may be a separate connecting piece joining divider wall 20*a* with divider wall 20*b* or it may be integrally formed with divider wall 20*a* and divider wall 20*b* such as a fold in a sheet of paper or the fused edges of two sheets of plastic or the molding of plastic to provide a flexible linking structure. It is the presence of hinge 22 which permits sections 12*a*, 12*b* to be separable from one another at the lower or bottom sidewall edge 30*a*, 30*b* of the container thus permitting the insertion of container 10 within container 10'**.

As has been stated, while the lower sidewall edges **30*a*, 30*b* of sections 12*a*, 12*b* are spaced apart or separated from one another, a first container 10 may be inserted into a second container 10'. Lip 24*a*, 24*b* and 24'*a*, 24'*b* is connected to upper sidewall edge 28*a*, 28*b* and 28'*a*, 28'*b* and serves to keep the containers separated and to provide a convenient edge for grasping a first container to separate it from a second container. Thus, referring now to FIG. 1, when container 10 is inserted within container 10' lip 24*a*, 24*b* will abut against lip 24'*a*, 24'*b* as container 10 is more deeply inserted into container 10'. When container 10 must be separated from container 10', lip 24*a*, 24*b*** is available to grasp and permits convenient and easy separation.

Again referring to FIG. 1, gap 26, may be observed between lip **24*a* and 24*b*. Gap 26 is the result of the absence or removal of a portion of lip 24a, 24b to permit movement of opposing sections 12a, 12b as they are separated at the bottom and as the respective portions of lip 24a, 24b atop sections 12a, 12b are compressed toward one another during the hinged movement of sections 12a, 12b of container 10**.

This feature is also illustrated in FIG. 2 where container 10 is shown in perspective view having lower sidewall edge 30a, 30b and base 14a, 14b of sections 12a, 12b spaced apart. This spacing is enabled as sections 12a, 12b of container 10 are separated from one another by the opening of hinge 22 causing divider wall 20a, 20b to separate at base 14a, 14b. During this movement, it will be appreciated that lip 24a associated with section 12a and lip 24b associated with section 12b will pivot inwardly into gap 26.

Figure 3:
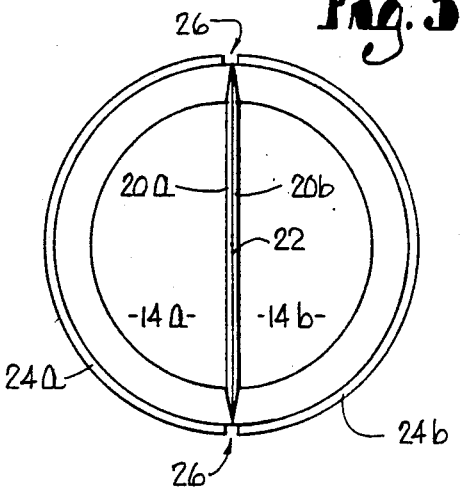
FIG. 3 is a plan view of a subdivided container showing the hinge between the two subdivisions.

Referring now to FIG. 3 hinge means or hinge 22 is positioned along upper sidewall edge 28a, 28b of divider wall 20a, 20b. Hinge 22 permits a hinge or scissor-like movement between sections 12a and 12b. The scissor or hinge movement of the container section portions 12a, 12b allow the formation of space or separation 32 (FIG. 1). This separation or spacing between sections 12a, 12b of container 10 permits container 10 to be inserted into container 10' and avoid the obstruction of divider walls 20a, 20b within container 10'. It will be appreciated that in the absence of the ability to form the space or separation between sections 12a, 12b of container 10 that divider walls 20a, 20b of container 10' would prevent insertion of container 10 within container 10'.

In conventional containers, dividers either must be inserted after the container is removed from the stack or the container cannot be stacked at all. An insertion-type divider is acceptable for dry foods. However, in the case of beverages and other fluids, an insertable divider will not segregate the liquid into one side or the other and, therefore, is unacceptable for any use in which it was desired to put a fluid into one or both sides.

Figure 5:
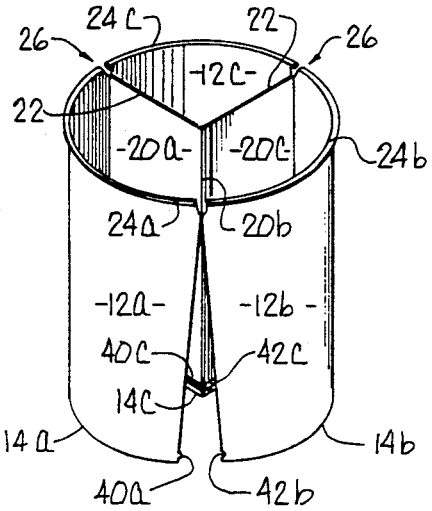
FIG. 5 shows a container subdivided into three units with the bottom portion separated for stacking of one within another.

Referring now to FIG. 5, an alternative embodiment is shown having three separate compartments rather than the two compartments of the embodiment of FIGS. 1-3. Still referring to FIG. 5, it will be appreciated that the number of compartments present in the container may be increased or diminished depending upon the application to which the container is to be utilized. It will also be appreciated that the spacing between container divider sidewalls 20a, 20b, 20c, can be varied. While the equidistant spacing of sidewalls 20a, 20b, 20c of FIG. 5 is most convenient for stacking the containers, as each of the three container segments will fit into the other, the spacing of the container segments and the number of container segments is determined by the application for which the container is intended.

Figure 4:
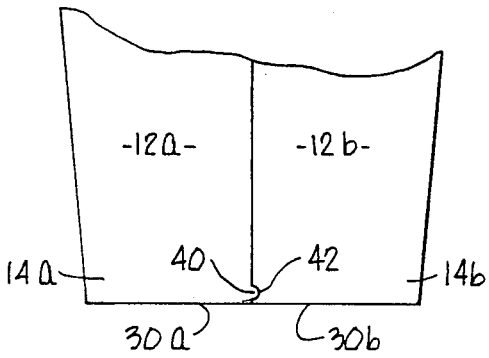
FIG. 4 is a fragmentary view of the container of FIG. 2 showing the bottom portions of the two subdivisions locked together for use by a consumer.

Referring now to FIG. 2 and FIG. 4 in conjunction with FIG. 5 the means of locking or latching together of container segments 12a, 12b will be considered. In FIG. 2 the presence of spacer or separation 32 may be observed between sections 12a, 12b of container 10. As discussed previously this separation permits the insertion of container 10 within container 10' while avoiding the obstruction of hinge 22 and divider walls 20'a, 20'b of container 10'. However, once the container is removed from being stacked with other containers, one inside the other, it is beneficial to secure section 12a to section 12b to provide additional stability to container 10 and to eliminate the possibility of sections 12a, 12b sliding apart and separating and possibly spilling the contents. To avoid this difficulty a latch or locking means is incorporated near base 14a, 14b of container 10 or lower sidewall edge 30a, 30b of divider walls 20a, 20b to allow the fixing together of sections 12a, 12b.

Referring now to FIG. 4, a fragmentary view of the container of FIGS. 1, 2 is shown in locked-together configuration. The latching or locking together of sections 12a, 12b to eliminate space or separation 32 is accomplished by a frictional fit between bead 40 on section 12a and detente 42 on section 12b. In FIGS. 1, and 2 bead 40 and detente 42 may be observed in their separated positions giving rise to spacer separation 32 between section 12a and section 12b. It will be appreciated by those skilled in the art that the frictional fit of bead 40 and detente 42 need only be sufficient to maintain section 12a and section 12b in contact with one another. A similar function could be performed by application of an adhesive to divider wall 20a of section 12a with section 12b being covered by a protective strip for removal at the time of latching or securing section 12a to section 12b. Another alternative method of securing or latching section 12a to section 12b could be to use a Velcro ® fastener to maintain section 12a adjacent to section 12b.

Referring now to FIG. 5, bead 40 and detente 42 may be observed near base 14a, 14b, 14c of each of the three sections shown. In the embodiment of FIG. 5 the container sections 12a, 12b, 12c, fit together and are latched or secured by a frictional fit between bead 40a, 40b, 40c and detente 42a, 42b, 42c.

Further sectional divisions, as represented in FIG. 5, may be accomplished by adding additional divider walls in the fashion illustrated. However, it may be more convenient to depart from the cylindrical configuration of the embodiments of FIGS. 1 and 5 and to utilize an in-line type configuration. In such an in-line configuration, the container section are rectangular and aligned in a row and hinged together at the top. A latch or locking mechanism is near the base of each section to secure the sections of the container together once removed from being stacked together.

A further use of the inventive cup is as a novelty item. In addition to be being a container, the application of a puppet-face design to the exterior of the container may permit use of the empty container as a hand puppet by small children. The design is oriented on the container such that space or separation 32 (FIG. 2) functions as a mouth when the container is oriented in sideways fashion. In this function as a novelty item, the hand of a child may be inserted into section 12b with the thumb in section 12a and the emptied container opened and shut to talk as would a hand puppet. It will be apparent that any type of appropriate puppet face could be applied to the exterior of the cup to maintain the child's attention.

It is to be understood that while certain forms of this invention have been illustrated and described, it is not limited thereto except insofar as such limitations are included in the following claims and allowable functional equivalents thereof.

Having thus described the invention what is claimed as new and desired to be secured by Letters Patent is as follows:

1. A divided container for food and beverages comprising:

first and second storage sections each presenting a sidewall having upper and lower sidewall edges, a hinge integrally formed between complemental portions of said upper sidewall edges of said first and second storage section to allow said lower sidewall edges of said first and second storage sections to be slightly spaced apart to permit insertion of a first container within a second container, and a latch on said container storage sections comprising:

a bead adjacent said lower sidewall edge of a first storage section, and a detente adjacent said lower sidewall edge of a second storage section said bead being registrable within said detente by a frictional fit to hold said first and second storage sections adjacent when said first container is withdrawn from said second container.

2. A container for food and beverages comprising:

first and second storage sections each presenting a sidewall having upper and lower sidewall edges, hinge means adjacent said upper sidewall edges joining complemental portions of said sidewalls for movement thereof between an open, storage position in which said lower sidewall edges are spaced slightly apart, and a use position in which said sidewalls are closed against each other, said sidewalls in said storage position being adapted to receive corresponding complemental portions of the sidewalls of another container of like configuration to nest the two together, and latch means on said storage sections to hold said lower sidewall edges together when said sidewall are in said use position.

3. The container as claimed in claim 2 wherein said hinge means is a connective piece of plastic integrally formed with said sidewalls of said first and second storage sections.

4. The container as claimed in claim 2 wherein said latch means comprises a bead adjacent said lower sidewall edge of said first storage section, and a detente adjacent said lower sidewall edge of said second storage section, said bead being registrable within said detente and held therein by frictional fit to secure said lower sidewall edges together.

5. The container as claimed in claim 2 further comprising a cover the sealing said first and second storage sections said cover having openings therein for insertion of a straw therethrough.

6. An assembly of containers for food and beverages comprising:

a first container comprising:

first and second storage sections each presenting a sidewall having upper and lower sidewall edges, hinge means adjacent said upper sidewall edges joining complemental portions of said sidewalls for movement thereof between an open, storage position in which said lower sidewall edges are spaced slightly apart, and a use position in which said sidewalls are closed against each other, said sidewalls in said storage position being adapted to receiv corresponding complemental portions of the sidewalls of another container of like configuration to nest the two together, and latch means on said storage sections to hold said sidewall edges together when said sidewalls are in said use position, a second container comprising:

first and second storage section each presenting a sidewall having upper and lower sidewall edges, hinge means adjacent said upper sidewall edges joining complemental portions of said sidewalls for movement thereof between an open, storage position in which said lower sidewall edges are spaced slightly apart, and a use position in which said sidewalls are closed against each other, said sidewalls in said storage position being adapted to receive corresponding complemental portions of the sidewalls of another container of like configuration to nest the two together, and latch means on said storage sections to hold said lower sidewall edges together when said sidewalls are in said use position, said container assembly formed by the reception of said corresponding complemental portions of said second container sections, while in said storage position, within said first container sections corresponding complemental portions to the nest the two containers.

7. The container as claimed in claim 6 wherein said latch means comprising a bead adjacent said lower sidewall edge of said first storage section, and a detente adjacent said lower sidewall edge of said second storage section, said bead being registrable within said detente and held therein by frictional fit to secure said lower sidewall edges together.

8. The container as claimed in claim 6 wherein said hinge means is a connective piece of plastic integrally formed with sidewalls of said first and second storage sections.

* * * * *

UNITED STATES PATENT AND TRADEMARK OFFICE

CERTIFICATE OF CORRECTION

PATENT NO. : 5,242,071

DATED : September 7, 1993

INVENTOR(S) : Scott A. Goebel

It is certified that error appears in the above-indentified patent and that said Letters Patent is hereby corrected as shown below:

Column 6, line 10, after the word "to" delete "receiv" and insert --receive-- therefor.

Column 6, line 13, after the second occurrence of "said" insert --lower-- therefor.

Column 6, line 47, after the word "with" insert --said-- therefor.

Signed and Sealed this

Twenty-ninth Day of March, 1994

Bruce Lehman

*Attest:*

BRUCE LEHMAN

*Attesting Officer*

*Commissioner of Patents and Trademarks*